US006387605B1

(12) United States Patent
Lynch et al.

(10) Patent No.: US 6,387,605 B1
(45) Date of Patent: May 14, 2002

(54) CO-DEVELOPERS FOR BLACK-AND-WHITE PHOTOTHERMOGRAPHIC ELEMENTS

(75) Inventors: Doreen C. Lynch, Afton; Paul G. Skoug, Stillwater, both of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/239,182

(22) Filed: Jan. 28, 1999

(51) Int. Cl.[7] ..... G03C 1/498

(52) U.S. Cl. ..... 430/350; 430/322; 430/363; 430/600; 430/607; 430/613; 430/619; 430/623

(58) Field of Search ..... 430/619, 350, 430/600, 322, 607, 363, 613, 623

(56) References Cited

U.S. PATENT DOCUMENTS

| | | | | |
|---|---|---|---|---|
| 3,457,075 A | | 7/1969 | Morgan et al. | |
| 3,839,049 A | | 10/1974 | Simons | |
| 4,260,677 A | | 4/1981 | Winslow et al. | |
| 5,496,695 A | | 3/1996 | Simpson et al. | |
| 5,512,411 A | | 4/1996 | Lynch et al. | |
| 5,536,662 A | | 7/1996 | Humphries et al. | |
| 5,545,505 A | | 8/1996 | Simpson | |
| 5,545,507 A | | 8/1996 | Simpson et al. | |
| 5,545,515 A | | 8/1996 | Murray et al. | |
| 5,558,983 A | | 9/1996 | Simpson et al. | |
| 5,635,339 A | * | 6/1997 | Murray | 430/350 |
| 5,637,449 A | | 6/1997 | Harring et al. | |
| 5,654,130 A | * | 8/1997 | Murray | 430/350 |
| 5,686,228 A | * | 11/1997 | Murray et al. | 430/350 |
| 6,232,059 B1 | * | 5/2001 | Yamada | 430/619 |

FOREIGN PATENT DOCUMENTS

| | | |
|---|---|---|
| EP | 0 803 765 A1 | 10/1997 |
| EP | 0 803 766 A1 | 10/1997 |
| EP | 0 897 130 A1 | 2/1999 |
| EP | 0 921 433 A1 | 6/1999 |
| EP | 0 803 764 B1 | 6/2001 |

OTHER PUBLICATIONS

Res. Disc. 6/78 #17029 p. 9–15.

* cited by examiner

*Primary Examiner*—Thorl Chea
(74) *Attorney, Agent, or Firm*—Louis M. Leichter; J. Lanny Tucker

(57) ABSTRACT

Novel co-developer compounds are useful in combination with hindered phenol developers to produce high contrast black-and-white photothermographic elements. The co-developer compounds have the formula

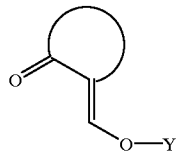

wherein: Y is H, a metal (preferably, an alkali metal), or an alkyl group (preferably, an alkyl group having from 1 to 4 carbon atoms), and the solid curved line represents the atoms and bonds necessary to complete a ring structure (preferably a 5 or 6 membered ring structure).

The photothermographic elements may be used as a photomask in a process where there is a subsequent exposure of an ultraviolet or short wavelength visible radiation-sensitive imageable medium.

15 Claims, No Drawings

CO-DEVELOPERS FOR BLACK-AND-WHITE PHOTOTHERMOGRAPHIC ELEMENTS

BACKGROUND OF THE INVENTION

1. Field of Invention

Novel co-developers in combination with hindered phenol developers have been found to produce very high contrast black-and-white photothermographic elements.

2. Background of the Art

Silver halide-containing, photothermographic imaging materials (i.e., heat-developable photographic elements) which are developed with heat and without liquid development have been known in the art for many years. These materials are also known as "dry silver" compositions or emulsions and generally comprise a support having coated thereon: (a) a photosensitive compound that generates silver atoms when irradiated; (b) a relatively or completely non-photosensitive, reducible silver source; (c) a reducing agent (i.e., a developer) for silver ion, for example, for the silver ion in the non-photosensitive, reducible silver source; and (d) a binder.

In photothermographic elements, the photosensitive compound is generally photographic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source within a catalytic sphere of influence around the silver specks. It has long been understood that silver atoms (Ag°) are a catalyst for the reduction of silver ions, and that the photosensitive silver halide can be placed into catalytic proximity with the non-photosensitive, reducible silver source in a number of different fashions (see, for example, *Research Disclosure*, Jun. 1978, Item No. 17029).

The silver halide may be made "in situ," for example by adding a halogen-containing source to a reducible silver source to achieve partial methasis and thus causing the in-situ formation of silver halide (AgX) grains throughout the silver soap (see, for example, U.S. Pat. No. 3,457,075).

The silver halide may also be pre-formed and prepared by an ex situ process whereby the silver halide (AgX) grains are prepared and grown in an aqueous or an organic solvent. It is reported in the art that when silver halide is made ex situ, one has the possibility of controlling the grain size, grain size distribution, dopant levels, and composition much more precisely, so that one can impart more specific properties to the photothermographic element and can do so much more consistently than with the in situ technique.

The silver halide grains prepared ex-situ may then be added to and physically mixed with the reducible silver salt.

A more preferable method is to prepare the reducible silver salt in the presence of the ex-situ prepared grains. In this process, the pre-formed grains are introduced prior to and are present during the formation of the silver soap. Co-precipitation of the silver halide and reducible silver source provides a more intimate mixture of the two materials (see, for example, M. J. Simons U.S. Pat. No. 3,839,049).

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic compounds, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image. This latent image is generally not visible by ordinary means. Thus, the photosensitive emulsion must be further developed to produce a visible image. This is accomplished by the reduction of silver ions which are in catalytic proximity to silver halide grains bearing the clusters of silver atoms (i.e., the latent image). This produces a black-and-white image. In photographic elements, the silver halide is reduced to form the black-and-white negative image in a conventional black-and-white negative imaging process. In photothermographic elements, the light-insensitive silver source is reduced to form the visible black-and-white negative image while much of the silver halide remains as silver halide and is not reduced.

In photothermographic elements, the reducing agent for the silver ion of the light-insensitive silver salt, often referred to as a "developer," may be any compound, preferably any organic compound, that can reduce silver ion to metallic silver and is preferably of relatively low activity until it is heated to a temperature above 100° C. At elevated temperatures, in the presence of the latent image, the silver ion of the non-photosensitive reducible silver source (e.g., silver carboxylate) is reduced by the reducing agent for silver ion. This produces a negative black-and-white image of elemental silver.

While conventional photographic developers such as methyl gallate, hydroquinone, substituted-hydroquinones, catechol, pyrogallol, ascorbic acid, and ascorbic acid derivatives are useful, they tend to result in very reactive photothermographic formulations and fog during preparation and coating of photothermographic elements. As a result, hindered phenol developers (i.e., reducing agents) have traditionally been preferred.

Differences Between Photothermography and Photography

The imaging arts have long recognized that the field of photothermography is clearly distinct from that of photography. Photothermographic elements differ significantly from conventional silver halide photographic elements which require wet-processing.

In photothermographic imaging elements, a visible image is created by heat as a result of the reaction of a developer incorporated within the element. Heat is essential for development. Temperatures of over 100° C. are routinely required. In contrast, conventional wet-processed photographic imaging elements require processing in aqueous processing baths to provide a visible image (e.g., developing and fixing baths). Development is usually performed at a more moderate temperature (e.g., about 30° C. to about 50° C.).

In photothermographic elements, only a small amount of silver halide is used to capture light and a different form of silver (e.g., silver carboxylate) is used to generate the image with heat. Thus, the silver halide serves as a catalyst for the physical development of the non-photosensitive, reducible silver source. In contrast, conventional wet-processed, black-and-white photographic elements use only one form of silver (e.g., silver halide); which, upon chemical development, is itself converted to the silver image; or which upon physical development requires addition of an external silver source. Additionally, photothermographic elements require an amount of silver halide per unit area that is as little as one-hundredth of that used in conventional wet-processed silver halide.

Photothermographic systems employ a light-insensitive silver salt, such as a silver carboxylate, which participates with the developer in developing the latent image. In contrast, chemically developed photographic systems do not employ a light-insensitive silver salt directly in the image-forming process. As a result, the image in photothermographic elements is produced primarily by reduction of the light-insensitive silver source (silver carboxylate) while the image in photographic black-and-white elements is produced primarily by the silver halide.

In photothermographic elements, all of the "chemistry" of the system is incorporated within the element itself. For example, photothermographic elements incorporate a developer (i.e., a reducing agent for the non-photosensitive reducible source of silver) within the element while conventional photographic elements do not. Even in so-called instant photography, the developer chemistry is physically separated from the photosensitive silver halide until development is desired. The incorporation of the developer into photothermographic elements can lead to increased formation of various types of "fog." Fog is spurious image density which appears in non-imaged areas of the photothermographic element and is often reported in sensitometric results as Dmin. Fog that occurs during manufacture of the photothermographic element is often referred to as initial fog or initial Dmin. Fog that occurs upon storage but before imaging is often referred to as shelf-aging fog. Fog that occurs after imaging as the imaged film ages; and is often referred to as processing as "post-processing fog" or "silver print-out." Much effort has gone into the preparation and manufacture of photothermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic elements, the binder is capable of wide variation and a number of binders are useful in preparing these elements. In contrast, photographic elements are limited almost exclusively to hydrophilic colloidal binders such as gelatin.

Because photothermographic elements require thermal processing, they pose different considerations and present distinctly different problems in manufacture and use. In addition, the effects of additives (e.g., stabilizers, antifoggants, speed enhancers, sensitizers, supersensitizers, etc.), which are intended to have a direct effect upon the imaging process, can vary depending upon whether they have been incorporated in a photothermographic element or incorporated in a photographic element.

Because of these and other differences, additives which have one effect in conventional silver halide photography may behave quite differently in photothermographic elements where the underlying chemistry is so much more complex. For example, it is not uncommon for an antifoggant for a silver halide system to produce various types of fog when incorporated into photothermographic elements.

Distinctions between photothermographic and photographic elements are described in *Imaging Processes and Materials* (*Neblette's Eighth Edition*); J. Sturge et al. Ed; Van Nostrand Reinhold: New York, 1989, Chapter 9; in *Unconventional Imaging Processes*; E. Brinclunan et al, Ed; The Focal Press: London and New York: 1978, pp. 74–75; and in C-f Zou, M. R. V. Shayun, B. Levy, and N Serpone *J. Imaging Sci. Technol.* 1996, 40, 94–103.

Use of Co-Developers in Photothermographic Elements

U.S. Pat. No. 5,496,695 describes hydrazide compounds useful as co-developers for black-and-white photothermographic and thermographic elements. These elements contain (i) a hindered phenol developer, and (ii) a trityl hydrazide or a formyl phenylhydrazine co-developer, and provide elements having high Dmax (>5.00), fast photospeeds, and high contrast (>20.0).

U.S. Pat. No. 5,545,505 described combinations of hindered phenol developers, a trityl hydrazide or a formyl phenylhydrazine, and amine compounds as co-developers for black-and-white photothermographic and thermographic elements.

U.S. Pat. No. 5,545,507 describes combinations of hindered phenol developers, a trityl hydrazide or a formyl phenylhydrazine, and hydroxamic acid compounds as co-developers for black-and-white photothermographic and thermographic elements.

U.S. Pat. No. 5,545,515 describes combinations of hindered phenol developers with acrylonitrile compounds as co-developers for black-and-white photothermographic and thermographic elements. A trityl hydrazide or a formyl phenylhydrazine co-developer may also be included.

U.S. Pat. No. 5,635,339 describes combinations of hindered phenol developers and 3-heteroaromatic-substituted acrylonitrile compounds as co-developers for black-and-white photothermographic and thermographic elements.

U.S. Pat. No. 5,637,449 describes combinations of hindered phenol developers, a trityl hydrazide or a formyl phenylhydrazine, and hydrogen atom donor compounds as co-developers for black-and-white photothermographic and thermographic elements.

U.S. Pat. No. 5,654,130 describes combinations of hindered phenol developers and 2-substituted malondialdehyde compounds as co-developers for black-and-white photothermographic and thermographic elements.

U.S. Pat. No. 5,705,324 describes combinations of hindered phenol developers and 4-substituted isoxazole compounds as co-developers for black-and-white photothermographic and thermographic elements.

It would be especially desirable to be able to achieve in dry photothermographic elements the high contrast that is currently available in wet silver halide materials. It would be advantageous to improve the reactivity of these dry systems, allow the reduction in the amount of silver by lowering the silver coating weights, reduce the amount of developer and co-developer compounds needed to achieve high contrast, and lower costs. New developing agent systems for use in photothermographic elements are therefore desired.

SUMMARY OF THE INVENTION

The present invention shows that a reducing agent system (i.e., a developer system) comprising: (i) at least one hindered phenol developer; and (ii) at least one co-developer as described below, provides black-and-white photothermogaphic elements that are capable of providing high photospeeds, stable, high density images with high resolution, good sharpness, high contrast, and good shelf stability using a dry and rapid process.

The reducing agent system (i.e., combination of one or more developers and one or more co-developers) used in this invention provide a significant improvement in image contrast when compared to photothermographic elements incorporating known developers or known developer combinations.

The black-and-white photothermographic elements of the present invention comprise a support having coated thereon an imaging coating (specifically, a photosensitive, image-forming, photothermographic coating) comprising:

(a) a photosensitive silver halide;

(b) a non-photosensitive, reducible silver source;

(c) a reducing agent system for the non-photosensitive, reducible silver source; and (d) a binder;

wherein the reducing agent system comprises:

(i) a hindered phenol developer;

(ii) a non-fogging co-developer of the formula:

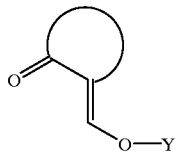

wherein: Y is H, a metal (preferably, an alkali metal), or an alkyl group (referably, an alkyl group having from 1 to 4 carbon atoms), and the solid curved line represents the atoms and bonds necessary to complete a ring structure. The ring structure can include one or more rings, including pendant and fused rings. In certain embodiments, the compounds include one main five- or six-membered ring, optionally having at least one pendant or fused ring attached to this main ring.

In particularly preferred embodiments, the non-fogging co-developer is soluble at room temperature (about 20° C. to about 25° C.) in an organic solvent used for coating the co-developer, which is typically methanol or methyl ethyl ketone (2-butanone). Preferably, at least about 10 milligrams (mg) of the non-fogging co-developer is soluble in 25 grams (g) of the solvent at room temperature.

Certain preferred co-developers are of the formula:

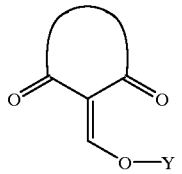

wherein Y and the solid curved line are as defined above.

Certain other preferred co-developers are of the formula:

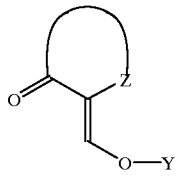

wherein Y and the solid curved line are as defined above and Z is S or N.

The present invention also provides a process for the formation of a visible image by first exposing to electromagnetic radiation and thereafter heating the inventive photothermographic element. In one embodiment, the present invention provides a process comprising:

(a) exposing the inventive photothermographic element on a support transparent to ultraviolet radiation or short wavelength visible radiation, to electromagnetic radiation to which the photosensitive silver halide of the element is sensitive to generate a latent image;

(b) heating the exposed element to develop the latent image into a visible image;

(c) positioning the element with a visible image thereon between a source of ultraviolet or short wavelength visible radiation energy and an ultraviolet or short wavelength radiation photosensitive imageable medium; and (d) thereafter exposing the imageable medium to ultraviolet or short wavelength visible radiation through the visible image on the element, thereby absorbing ultraviolet or short wavelength visible radiation in the areas of the element where there is a visible image and transmitting ultraviolet or short wavelength visible radiation through areas of the element where there is no visible image.

The photothermographic elements of this invention can be used, for example, in conventional black-and-white photothermography, in electronically generated black-and-white hardcopy recording, in the graphic arts area (e.g., image-setting and phototypesetting), in digital proofing, and in digital radiographic imaging. Furthermore, the absorbance of these photothermographic elements between 350 nanometers (nm) to 450 nm is sufficiently low (less than 0.50) to permit their use in graphic arts applications such as contact printing, proofing, and duplicating ("duping").

In photothermographic elements of the present invention, the components of the imaging coating can be in one or more layers. The layer(s) that contain the photosensitive silver halide and non-photosensitive, reducible silver source are referred to herein as emulsion layer(s). The silver halide and the non-photosensitive, reducible saver source are in catalytic proximity, and preferably in the same emulsion layer. According to the present invention, one or more components of the reducing agent system can be added either to the emulsion layer(s) or to one or more layer(s) adjacent to the emulsion layer(s). Layers that are adjacent to the emulsion layer(s) may be, for example, protective topcoat layers, primer layers, interlayers, opacifying layers, antistatic layers, antihalation layers, barrier layers, auxiliary layers, etc. It is preferred that the reducing agent system is present in the photothermographic emulsion layer or topcoat layer.

When the photothermographic element used in this invention is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained. The photothermographic element may be exposed in step (a) with visible, infrared, or laser radiation such as from an infrared laser or an infrared laser diode.

In the descriptions of the photothermographic elements of the present invention, "a" or "an" component refers to "at least one" of that component. For example, in the element described above, the reducing agent system can include one hindered phenol developer or a mixture of such developers. In addition, the co-developer can include one co-developer or a mixture of such developers.

Heating in a substantially water-free condition as used herein, means heating at a temperature of 80° to 250° C. with little more than ambient water vapor present. The term "substantially water-free condition" means that the reaction system is approximately in equilibrium with water in the air, and water for inducing or promoting the reaction is not particularly or positively supplied from the exterior to the element. Such a condition is described in T. H. James, *The Theory of the Photographic Process*, Fourth Edition, Macmillan 1977, page 374.

As used herein:

"Photothermographic element" means a construction comprising at least one photothermographic emulsion layer or a two trip photothermographic set of layers (the "two-trip coating where the silver halide and the reducible silver source are in one layer and the other essential components or desirable additives are distributed as desired in an adjacent coating layer) and any supports, topcoat layers, image-receiving layers, blocking layers, antihalation layers, subbing or priming layers, etc.

"Emulsion layer" means a layer of a photothermographic element that contains the photosensitive silver halide and non-photosensitive reducible silver source material.

"Ultraviolet region of the spectrum" means that region of the spectrum less than or equal to about 400 nm, preferably from about 100 nm to about 400 nm (sometimes marginally inclusive up to 405 or 410 nm, although these ranges are often visible to the naked human eye), preferably from about 100 nm to about 400 nm. More preferably, the ultraviolet region of the spectrum is the region between about 190 nm and about 400 nm.

"Visible region of the spectrum" means from about 400 nm to about 750 nm.

"Short wavelength visible region of the spectrum" means that region of the spectrum from about 400 nm to about 450 nm.

"Red region of the spectrum" means from about 640 nm to about 750 nm. Preferably the red region of the spectrum is from about 650 nm to about 700 nm.

"Infrared region of the spectrum" means from about 750 nm to about 1400 nm.

Other aspects, advantages, and benefits of the present invention are apparent from the detailed description, examples, and claims.

DETAILED DESCRIPTION OF THE INVENTION

In photothermographic elements there exists the desire for products which exhibit increased contrast upon exposure to light and subsequent development. This desire is based upon the realization that contrast is directly related to the appearance of sharpness. Thus, products which exhibit increased contrast give the visual impression of enhanced sharpness.

Traditionally contrast has been defined by two methods, both of which are derived from the D—Log E curve. The first method is the determination of gamma, γ, which is defined as the slope of the straight-line section of the D—log E curve between two specified densities. The second is the determination of the overall sharpness of the toe section of the D—log E curve. By sharpness of the toe section, it is usually meant the relative change in density with exposure in the toe section of the traditional D—Log E curve. For instance, a sharp toe corresponds to a very rapid rise in density (at low levels of density) with exposure, whereas a soft toe is corresponds to a very gradual rise in density (at low levels of density) with exposure. If either the value of γ is high or the toe is sharp, then the image has a relatively high contrast. If the value of γ is low, or the toe is soft, the image has a relatively low contrast. Contrast must also be maintained throughout the exposure range. Thus, stable, high density images with high resolution, good sharpness, high contrast, at densities between about 2.0 and $D_{max}$ are also required to achieve sharp images.

The contrast is typically optimized for each particular use. For some uses, certain parts of the sensitometric curve are modified to increase or decrease the contrast of the product.

Photothermographic systems have not found widespread use as replacements for wet silver halide in imaging systems because of slow speed, low $D_{max}$, poor contrast, and insufficient sharpness at high $D_{max}$. Conventional photothermographic elements comprising only bisphenol developers rarely exhibit a γ greater than about 3.0. These materials are well suited to medical imaging and similar uses where continuous tone reproduction is required, but they are not adequate for graphic arts uses where a much higher γ (e.g., >5.0) is typically necessary.

The shape of the sensitometric D—Log E curve for photothermographic elements of this invention incorporating the co-developers described herein is similar to that observed for infectious development curves in hard dot black-and-white conventionally processed wet silver halide image-setting films. This allows the preparation of improved hard dot dry silver masks of high image quality useful for the production of plates in image-setting applications, contact proofs, and duplicating films also useful in the graphic arts. These masks are presently produced from conventional wet silver halide materials.

The Reducing Agent System for the Non-Photosensitive Reducible Silver Source

In the black-and-white photothermographic elements of the present invention, the reducing agent system (i.e., the developer system) for the organic silver salt comprises at least one hindered phenol developer and at least one non-fogging co-developer of the formula:

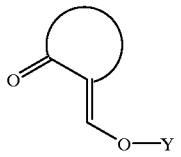

wherein: Y is H, a metal (preferably, an alkali metal), or an alkyl group (referably, an alkyl group having from 1 to 4 carbon atoms.), and the solid curved line represents the atoms and bonds necessary to complete a ring structure.

Hindered phenol developers are compounds that contain only one hydroxy group on a given phenyl ring and have at least one additional substituent located ortho to the hydroxy group. They differ from traditional photographic developers, which contain two hydroxy groups on the same phenyl ring (such as is found in hydroquinones). Hindered phenol developers may contain more than one hydroxy group as long as each hydroxy group is located on different phenyl rings. Hindered phenol developers include, for example, binaphthols (i.e., dihydroxybinaphthyls), biphenols (i.e., dihydroxybiphenyls), bis(hydroxynaphthyl)methanes, bis (hydroxy-phenyl)methanes, hindered phenols, and hindered naphthols each of which may be variously substituted.

Non-limiting representative binaphthols include 1,1'-bi-2-naphthol; 1,1'-bi-4-methyl-2-naphthol; and 6,6'-dibromo-bi-2-naphthol. For additional compounds see U.S. Pat. No. 5,262,295 at column 6, lines 12–13, incorporated herein by reference.

Non-limiting representative biphenols include 2,2'-dihydroxy-3,3'-di-t-butyl-5,5-dimethylbiphenyl; 2,2'- dihydroxy-3,3', 5,5'-tetra-t-butylbiphenyl; 2,2'-dihydroxy-3,3'-di-t-butyl-5,5'-dichlorobiphenyl; 2-(2-hydroxy-3-t-butyl-5-methylphenyl)-4-methyl-6-n-hexylphenol; 4,4'-dihydroxy-3,3', 5,5'-tetra-t-butyl-biphenyl; and 4,4'-dihydroxy-3,3',5,5'-tetramethylbiphenyl. For additional compounds see U.S. Pat. No. 5,262,295 at column 4, lines 17–47, incorporated herein by reference.

Non-limiting representative bis(hydroxynaphthyl) methanes include 4,4'-methylenebis(2-methyl- 1 -naphthol). For additional compounds see U.S. Pat. No. 5,262,295 at column 6, lines 14–16, incorporated herein by reference.

Non-limiting representative bis(hydroxyphenyl)methanes include bis(2-hydroxy-3-t-butyl-5-methylphenyl)methane (CAO-5); 1,1-bis(2-hydroxy-3,5-dimethylphenyl)-3,5,5-trimethylhexane (NONOX; PERMANAX WSO); 1,1-bis(3,5-di-t-butyl-4-hydroxyphenyl)methane; 2,2-bis(4-hydroxy-3-methyl-phenyl)propane; 4,4-ethylidene-bis(2-t-butyl-6-methylphenol); and 2,2-bis(3,5-dimethyl-4-hydroxyphenyl) propane. For additional compounds see U.S. Pat. No. 5,262,295 at column 5, line 63, to column 6, line 8, incorporated herein by reference.

Non-limiting representative hindered phenols include 2,6-di-t-butylphenol; 2,6-di-t-butyl-4-methylphenol; 2,4-di-t-butylphenol; 2,6-dichlorophenol; 2,6-dimethylphenol; and 2-t-butyl-6-methylphenol.

Non-limiting representative hindered naphthols include 1-naphthol;

4-methyl-1-naphthol; 4-methoxy-1-naphthol; 4-chloro-1-naphthol; and 2-methyl-1-naphthol. For additional compounds see U.S. Pat. No. 5,262,295 at column 6, lines 17–20, incorporated herein by reference.

The co-developer has the following formula:

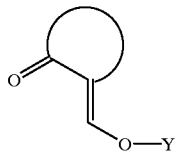

wherein: Y is H, a metal (preferably, an alkali metal, and more preferably, sodium or potassium), or an alkyl group (preferably, an alkyl group having from 1 to 4 carbon atoms, and more preferably, a methyl or ethyl group), and the solid curved line represents the atoms and bonds necessary to complete a ring structure, which may include heteroatoms (e.g., N, O, S). The ring structure can include one or more rings, including pendant and fused rings. In certain embodiments, the compounds include one main five- or six-membered ring, which may include heteroatoms within the ring, and optionally have at least one pendant or fused ring attached to this main ring. In particularly preferred embodiments, the co-developer is a non-fogging soluble compound.

Certain preferred co-developers are of the formula:

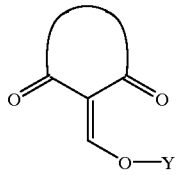

wherein Y is as defined above and the solid curved line represents the atoms and bonds necessary to complete a ring structure as defined above. Certain other preferred co-developers are of the formula:

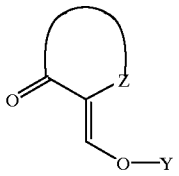

wherein Y is as defined above, Z is S or N, and the solid curved line represents the atoms and bonds necessary to complete a ring structure as defined above.

The co-developer compounds may be prepared by procedures known in the art and by procedures as described later herein. Representative co-developer compounds useful in the present invention are shown below. These representations are exemplary and are not intended to be limiting.

I-01

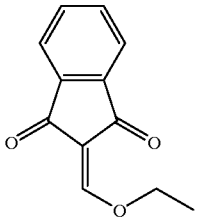

I-02

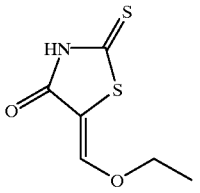

I-03

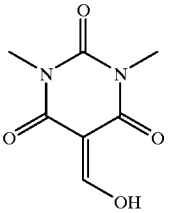

I-04

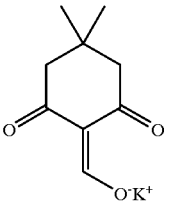

I-05

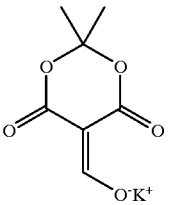

-continued

I-06

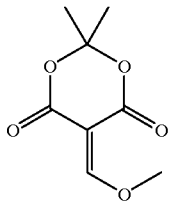

I-07

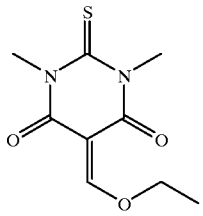

I-08

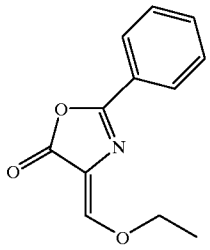

The following are comparative examples that either are insoluble in a desired coating solvent (e.g., MEK or methanol) or fog a coated photothermographic emulsion.

CI-01

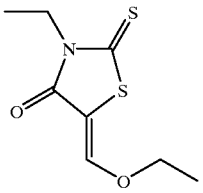

CI-02

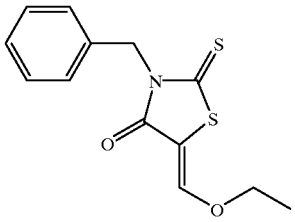

CI-03

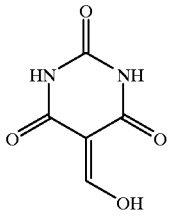

The amounts of the above described reducing agents of the reducing agent system that are added to the photothermographic element of the present invention may be varied depending upon the particular compound used, upon the type of emulsion layer, and whether components of the reducing agent system are located in the emulsion layer or a topcoat layer.

If both the hindered phenol developer and the co-developer of the reducing agent system are present in the emulsion layer, the hindered phenol developer is preferably present in an amount of about 1% by weight to about 15% by weight of the imaging coating, which can include emulsion layers, topcoats, etc. The co-developer is preferably present in an amount of about 0.01% by weight to about 1.5% by weight of the imaging coating.

In multilayer photothermographic constructions, if one of the developers of the reducing agent system is added to a layer other than the emulsion layer, slightly higher proportions may be necessary. In such constructions, the hindered phenol is preferably present in an amount of about 2% to about 20% by weight, and the co-developer is preferably present in an amount of about 0.2% to about 20% by weight, of the layer in which it is present. The reducing agent system is usually present in an amount of about 1% to 20% by weight of the imaging coating.

When present in the emulsion layer, the hindered phenol is preferably present in an amount of about 0.01 mole to about 50 moles, and more preferably, about 0.05 mole to about 25 moles, per mole of silver halide; and the co-developer is preferably present in an amount of about 0.0005 mole to about 25 moles, and more preferably, about 0.0025 mole to about 10 moles, per mole of the silver halide.

Photothermographic elements of the invention may contain other co-developers or mixtures of co-developers in combination with the co-developers of this invention. For example, the trityl hydrazide or formyl phenylhydrazine compounds described in U.S. Pat. No. 5,496,695 may be used; the amine compounds described in U.S. Pat. No. 5,545,505 may be used; the hydroxamic acid compounds described in U.S. Pat. No. 5,545,507 may be used; the acrylonitrile compounds described in U.S. Pat. No. 5,545,515 may be used; the 3-heteroaromatic-substituted acrylonitrile compounds described in U.S. Pat. No. 5,635,339 may be used; the hydrogen atom donor compounds described in U.S. Pat. No. 5,637,449 may be used; the 2-substituted malondialdehyde compounds described in U.S. Pat. No. 5,654,130 may be used; and/or the 4-substituted isoxazole compounds described in U.S. Pat. No. 5,705,324 may be used.

Photothermographic elements of the invention may also contain other additives such as shelf-life stabilizers, toners, development accelerators, acutance dyes, post-processing stabilizers or stabilizer precursors, and other image-modifying agents.

The Photosensitive Silver Halide

As noted above, the present invention includes a photosensitive silver halide. The photosensitive silver halide can be any photosensitive silver halide, such as silver bromide, silver iodide, silver chloride, silver bromoiodide, silver chlorobromoiodide, silver chlorobromide, etc.

The silver halide may be in any form that is photosensitive including, but not limited to cubic, octahedral, rhombic dodecahedral, orthorhombic, tetrahedral, other polyhedral habits, etc., and may have epitaxial growth of crystals thereon.

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell silver halide grains useful in photothermographic elements and methods of preparing these materials are described in U.S. Pat. No. 5,382,504. A core-shell silver halide grain having an iridium-doped core is particularly preferred. Iridium doped core-shell grains of this type are described in U.S. Pat. No. 5,434,043.

The photosensitive silver halide can be added to the emulsion layer in any fashion so long as it is placed in catalytic proximity to the light-insensitive reducible silver compound that serves as a source of reducible silver.

It is preferred to that the silver halide be pre-formed and prepared by an ex-situ process. The silver halide grains prepared ex-situ may then be added to and physically mixed with the reducible silver source. It is more preferable to form the non-photosensitive reducible silver source in the presence of ex-situ prepared silver halide. In this process, silver soap is formed in the presence of the pre-formed silver halide grains. Co-precipitation of the silver halide and reducible source of silver provides a more intimate mixture of the two materials (see, for example, M. J. Simons U.S. Pat. No. 3,839,049). Materials of this type are often referred to as "pre-formed emulsions."

It is desirable in the practice of this invention with photothermographic elements to use pre-formed silver halide grains of less than 0.10 $\mu$m in an infrared sensitized, photothermographic material. It is also preferred to use iridium doped silver halide grains and iridium doped core-shell silver halide grains as disclosed in European Laid Open Patent Application No 0 627 660 and U.S. Pat. No. 5,434,043 described above.

Pre-formed silver halide emulsions used in the material of this invention can be unwashed or washed to remove soluble salts. In the latter case, the soluble salts can be removed by chill-setting and leaching or the emulsion can be coagulation washed (e.g., by the procedures described in U.S. Pat. Nos. 2,618,556; 2,614,928; 2,565,418; 3,241,969; and 2,489,341).

It is also effective to use an in situ process in which a halogen-containing compound is added to an organic silver salt to partially convert the silver of the organic silver salt to silver halide.

Additional methods of preparing these silver halide and organic silver salts and manners of blending them are described in *Research Disclosure*, Jun. 1978, item 17029; U.S. Pat. Nos. 3,700,458 and 4,076,539; and Japanese Patent Application Nos. 13224/74, 42529/76, and 17216/75.

The light-sensitive silver halide used in the photothermographic elements of the present invention is preferably present in an amount of about 0.005 mole to about 0.5 mole, more preferably, about 0.01 mole to about 0.15 mole per mole, and most preferably, about 0.03 mole to about 0.12 mole, per mole of non-photosensitive reducible silver salt.

Sensitizers

The silver halide used in the present invention may be chemically and spectrally sensitized in a manner similar to that used to sensitize conventional wet-processed silver halide photographic materials or state-of-the-art heat-developable photothermographic elements.

For example, it may be chemically sensitized with a chemical sensitizing agent, such as a compound containing sulfur, selenium, tellurium, etc., or a compound containing gold, platinum, palladium, ruthenium, rhodium, iridium, or combinations thereof, etc., a reducing agent such as a tin halide, etc., or a combination thereof. The details of these procedures are described in T. H. James, *The Theory of the Photographic Process*, Fourth Edition, Chapter 5, pp. 149 to 169. Suitable chemical sensitization procedures are also disclosed in U.S. Pat. Nos. 1,623,499; 2,399,083; 3,297,447; and 3,297,446. One preferred method of chemical sensitization is by oxidative decomposition of a spectral sensitizing dye in the presence of a photothermographic emulsion. Such methods are described in Winslow et al., PCT Publication No. WO 9845754 (U.S. patent application Ser. No. 08/841,953, filed Apr. 8, 1997) and incorporated herein by reference.

The addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful. Suitable sensitizing dyes such as described, for example, in U.S. Pat. Nos. 3,719,495; 5,393,654; 5,441,866; and 5,541,054 are particularly effective.

An appropriate amount of sensitizing dye added is generally about $10^{-10}$ to $10^{-1}$ mole; and preferably, about $_{10}{}^{-8}$ to $10^{-3}$ moles per mole of silver halide.

Supersensitizers

To enhance the speed and sensitivity of the photothermographic elements, it is often desirable to use supersensitizers. Any supersensitizer can be used that increases the sensitivity to light. For example, preferred infrared supersensitizers are described in European Laid Open Patent Application No. 0 559 228 and include heteroaromatic mercapto compounds or heteroaromatic disulfide compounds of the formulae: Ar—S—M and Ar—S—S—Ar, wherein M represents a hydrogen atom or an alkali metal atom.

In the above noted supersensitizers, Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. However, compounds having other heteroaromatic rings are envisioned to be suitable supersensitizers for use in the elements of the present invention.

The heteroaromatic ring may also carry substituents. Examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms.

Most preferred supersensitizers are 2-mercaptobenzimidazole, 2-mercapto-5-methylbenzimidazole (MMBI), 2-mercaptobenzothiazole, and 2-mercapto-benzoxazole (MBO).

If used, a supersensitizer is preferably present in an emulsion layer in an amount of at least about 0.001 mole per mole of silver m the emulsion layer. More preferably, a supersensitizer is present within a range of about 0.001 mole to about 1.0 mole, and most preferably, about 0.01 mole to about 0.3 mole, per mole of silver halide.

The Non-Photosensitive Reducible Silver Source Material

The non-photosensitive reducible silver source used in the elements of the present invention can be any material that contains a source of reducible silver ions. Preferably, it is a silver salt that is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methyl-benzoate, silver m-methylbenzoate, silver p-methylbenzoate, silver 2,4-dichloro-benzoate, silver acetamidobenzoate, silver p-phenylbenzoate, etc.; silver gallate-silver tannate; silver phthalate; silver terephthalate; silver salicylate; silver phenylacetate; silver pyromellilate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663. Soluble silver carboxylates having increased solubility in coating solvents and affording coatings with less light scattering can also be used. Such silver carboxylates are described in U.S. Pat. No. 5,491,059.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a saver salt of 2-(2-ethylglycolamido) benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-l-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include: silver salts of benzotriazole and substituted derivatives thereof, for example, silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

Silver salts of acetylenes can also be used. Silver acetylides are described in U.S. Pat. Nos. 4,761,361 and 4,775,613.

It is also found convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial carboxylic acid.

Transparent sheet materials made on transparent film backing require a transparent coating. For this purpose a silver carboxylate full soap, containing not more than about 15% of free carboxylic acid and analyzing about 22% silver, can be used.

The method used for making silver soap emulsions is well known in the art and is disclosed in *Research Disclosure*, April 1983, item 22812, *Research Disclosure*, October 1983, item 23419, and U.S. Pat. No. 3,985,565.

The silver halide and the non-photosensitive reducible silver source that form a starting point of development should be in catalytic proximity (i.e., reactive association). "Catalytic proximity" or "reactive association" means that they should be in the same layer, in adjacent layers, or in layers separated from each other by an intermediate layer having a thickness of less than 1 micrometer (1 $\mu$m). It is preferred that the silver halide and the non-photosensitive reducible silver source be present in the same layer.

Photothermographic emulsions containing pre-formed silver halide in accordance with this invention can be sensitized with chemical sensitizers, and/or with spectral sensitizers as described above.

The source of reducible silver is preferably present in an amount of about 5% by weight to about 70% by weight, and more preferably, about 10% to about 5% by weight, based on the total weight of the emulsion layers.

The Binder

The photosensitive silver halide, the non-photosensitive reducible source of silver, the reducing agent system, and any other additives used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc., a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers (e.g., terpolymers) are also included in the definition of polymers. The polyvinyl acetals, such as polyvinyl butyral and polyvinyl formal, and vinyl copolymers such as polyvinyl acetate and polyvinyl chloride are particularly preferred.

Although the binder can be hydrophilic or hydrophobic, preferably it is hydrophobic in the silver-containing layer(s). Optionally, these polymers may be used in combination of two or more thereof.

Where the proportions and activities of the reducing agent system for the non-photosensitive reducible source of silver require a particular developing time and temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art. Preferably, a binder is used at a level of about 30% by weight to about 90% by weight, and more preferably at a level of about 45% by weight to about 85% by weight, based on the total weight of the layer in which they are included.

Photothermographic Formulations

The formulation for the photothermographic emulsion layer can be prepared by dissolving and dispersing the binder, the photosensitive silver halide, the non-photosensitive reducible source of silver, the reducing agent system for the non-photosensitive reducible silver source, and optional additives in an inert organic solvent, such as, for example, toluene, 2-butanone, or tetrahydrofuran.

The use of "toners" or derivatives thereof which improve the image is highly desirable, but is not essential to the element. Preferably, if used, a toner can be present in an amount of about 0.01% by weight to about 10%, and more preferably about 0.1% by weight to about 10% by weight, based on the total weight of the layer in which it is included. Toners are usually incorporated in the photothermographic emulsion layer Toners are well known materials in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)-phthalimide, and N-(dimethylaminomethyl)naphthalene-2,3 -dicarboximide; a combination of blocked pyrazoles, isothiuronium derivatives, and certain photo-bleach agents, such as a combination of N,N'-hexamethylene-bis(l-carbamoyl-3,5-dimethylpyrazole), 1,8-(3,6-diazaoctane)bis(isothiuronium) trifluoroacetate, and 2-(tribromomethylsulfonyl benzothiazole); merocyanine dyes such as 3-ethyl-5-[(3-ethyl-2-benzothiazolinylidene)-1-methyl-ethylidene]-2-thio-2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydrc-1,4-phthalazinedione; a combination of phthalazine plus one or more phthalic acid derivatives, such as phthalic acid, 4-methylphthalic acid, 4-nitrophthalic acid, and tetrachilorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4-dione, and 6-nitro-1,3-benzoxazine-2,4-dione; pyrimidines and asym-triazines, such as 2,4-dihydroxy-pyrimidine, 2-hydroxy-4-aminopyrimidine, and azauracil; and tetraazapentalene derivatives, such as 3,6-dimercapto-1,4-diphenyl-1H, 4H-2,3 a,5,6a-tetraaza-pentalene and 1,4-di-(o-chlorophenyl)-3,6-dimercapto-1H,4H-2,3a, 5,6a-tetraazapentalene.

The photothermographic elements of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. Nos. 2,131,039 and 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; the palladium, platinum and gold salts described in U.S. Pat. Nos. 2,566,263 and 2,597,915; and the 2-(tribromomethylsulfonyl)quinoline compounds described in U.S. Pat. No. 5,460,938. Stabilizer precursor compounds capable of releasing stabilizers upon application of heat during development can also be used in combination with the stabilizers of this invention. Such precursor compounds are described in, for example, U.S. Pat. Nos. 5,158,866; 5,175,081; 5,298,390; and 5,300,420.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

Photothermographic elements of the invention can contain matting agents such as starch, titanium dioxide, zinc oxide, silica, and polymeric beads including beads of the type described in U.S. Pat. Nos. 2,992,101 and 2,701,245.

The photothermographic elements of the present invention may contain antistatic or conducting layers. Such layers may contain soluble salts (e.g., chlorides, nitrates, etc.), evaporated metal layers, ionic polymers such as those described in U.S. Pat. Nos. 2,861,056 and 3,206,312, or insoluble inorganic salts such as those described in U.S. Pat. No. 37428,451.

The photothermographic elements of this invention may also contain electroconductive underlayers to reduce static electricity effects and improve transport through processing equipment. Such layers are described in U.S. Pat. No. 5,310,640.

Photothermographic Constructions

The photothermographic elements of this invention may be constructed of one or more layers on a support. Single layer elements should contain the silver halide, the non-photosensitive reducible silver source material, the reducing agent system for the non-photosensitive reducible silver source, the binder, as well as optional materials such as toners, acutance dyes, coating aids, and other adjuvants.

Two layer constructions (often referred to as two-trip constructions because of the coating of two distinct layers on the support) preferably contain silver halide and non-photosensitive reducible silver source in one emulsion layer (usually the layer adjacent to the support) and the reducing agent system and other ingredients in the second layer or distributed between both layers. If desired, the developer and co-developer may be in separate layers. Two layer constructions comprising a single emulsion layer coating containing all the ingredients and a protective topcoat are also envisioned.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. Nos. 2,761,791 and 5,340,613; and British Patent No. 837,095. A typical coating gap for the emulsion layer can be about 10 micrometers ($\mu$m) to about 150 $\mu$m, and the layer can be dried in forced air at a temperature of about 20° C. to about 100° C. It is preferred that the thickness of the layer be selected to provide maximum image densities greater than about 0.2, and, more preferably, in a range of about 0.5 to about 4.0, as measured by a MacBeth Color Densitometer Model TD 504.

Photothermographic elements according to the present invention can contain acutance dyes and antihalation dyes. The dyes may be incorporated into the photothermographic emulsion layer as acutance dyes according to known techniques. The dyes may also be incorporated into antihalation layers according to known techniques as an antihalation backing layer, an antihalation underlayer or as an overcoat. It is preferred that the photothermographic elements of this invention contain an antihalation coating on the support opposite to the side on which the emulsion and topcoat layers are coated. Antihalation and acutance dyes useful in the present invention are described in U.S. Pat. Nos. 5,135,842; 5,266,452; 5,314,795; and 5,380,635.

Development conditions will vary, depending on the construction used, but will typically involve heating the imagewise exposed material at a suitably elevated temperature. The latent image obtained after exposure can be developed by heating the material at a moderately elevated temperature of, for example, about 80° C. to about 250° C., preferably about 100° C. to about 200° C., for a sufficient period of time, generally about 1 second to about 2 minutes. Heating may be carried out by the typical heating means such as a hot plate, an iron, a hot roller, a heat generator using carbon or titanium white, a resistive layer in the element, or the like.

If desired, the imaged element may be subjected to a first heating step at a temperature and for a time sufficient to intensify and improve the stability of the latent image but insufficient to produce a visible image and later subjected to a second heating step at a temperature and for a time sufficient to produce the visible image. Such a method and its advantages are described in U.S. Pat. No. 5,279,928.

The Support

Photothermographic emulsions used in the invention can be coated on a wide variety of supports. The support, or substrate, can be selected from a wide range of materials depending on the imaging requirement. Supports may be transparent or at least translucent. Typical supports include polyester film, subbed polyester film (e.g., polyethylene terephthalate or polyethylene naphthalate), cellulose acetate film, cellulose ester film, polyvinyl acetal film, polyolefinic film (e.g., polyethylene or polypropylene or blends thereof), polycarbonate film, and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good dimensional stability upon heating and development, such as polyesters. Particularly preferred polyesters are polyethylene terephthalate and polyethylene naphthalate.

Where the photothermographic element is to be used as a photomask, the support should be transparent or highly transmissive of the radiation (i.e., ultraviolet or short wavelength visible radiation) used in the final imaging process.

A support with a backside resistive heating layer can also be used in photothermographic imaging systems such as shown in U.S. Pat. No. 4,374,921.

Use as a Photomask

The possibility of absorbance of the photothermographic elements of the present invention in the range of about 350 nm to about 450 nm in non-imaged areas facilitates the use of the photothermographic elements of the present invention in a process where there is a subsequent exposure of an ultraviolet or short wavelength visible radiation sensitive imageable medium. For example, imaging the photothermographic element and subsequent development affords a visible image. The developed photothermographic element absorbs ultraviolet or short wavelength visible radiation in the areas where there is a visible image and transmits ultraviolet or short wavelength visible radiation where there is no visible image. The developed element may then be used as a mask and placed between an ultraviolet or short wavelength visible radiation energy source and an ultraviolet or short wavelength visible radiation photosensitive imageable medium such as, for example, a photopolymer, diano material, or photoresist. This process is particularly useful where the imageable medium comprises a printing plate and the photothermographic element serves as an imagesetting film.

Objects and advantages of this invention will now be illustrated by the following examples, but the particular materials and amounts thereof recited in these examples, as well as other conditions and details, should not be construed to unduly limit this invention.

EXAMPLES

All materials used in the following examples are readily available from standard commercial sources, such as Aldrich Chemical Co., Milwaukee, Wis., unless otherwise specified. All percentages are by weight unless otherwise indicated. The following additional terms and materials were used.

ACRYLOID A-21 is an acrylic copolymer available from Rohm and Haas, Philadelphia, Pa.

BUTVAR B-79 is a polyvinyl butyral resin available from Monsanto Company, St. Louis, Mo.

CAB 171-15 is a cellulose acetate butyrate resin available from Eastman Kodak Co.

CBBA is 2-(4-chlorobenzoyl)benzoic acid.

DESMODUR N3300 is an aliphatic hexamethylene diisocyanate available from Bayer Chemicals, Pittsburgh, Pa.

N-Ethyl-rhodanine is a compound of the following structure:

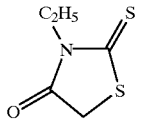

MEK is methyl ethyl ketone (2-butanone).

MeOH is methanol.

MMBI is 2-mercapto-5-methylbenzimidazole. 4-MPA is 4-methylphthalic acid.

PERMANAX WSO is 1,1-bis(2-hydroxy-3,5-dimethylphenyl)-3,5,5-trimethylhexane [CAS RN=7292-14-0] and is available from St-Jean PhotoChemicals, Inc., Quebec. It is a reducing agent (i.e., a hindered phenol developer) for the non-photosensitive reducible source of silver. It is also known as NONOX.

PET is polyethylene terephthalate.

PHP is pyridinium hydrobromide perbromide.

PHZ is phthalazine.

TCPA is tetrachlorophthalic acid.

TCPAN is tetrachlorophthalic anhydride.

Sensitizing Dye-1 is described in U.S. Pat. No. 5,541,054 and has the following structure:

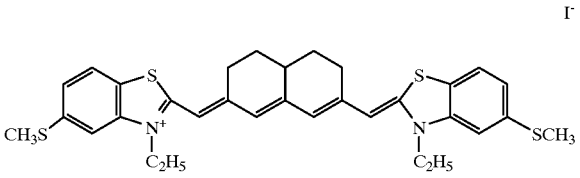

Compound CN-08 is described in U.S. Pat. No. 5,545,515 and has the following structure:

CN-08

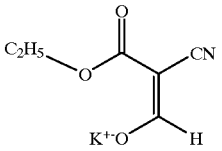

Compound CN-14 has the following structure:

CN-14

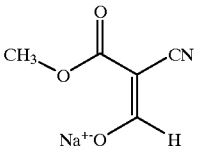

Compound Pr.-01 is described in U.S. Pat. No. 5,686,228 and has the following structure:

Pr-01

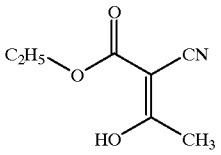

Antifoggant A is 2-(tribromomethylsulfonyl)quinoline and is described in U.S. Pat. No. 5,460,938. It has the following structure:

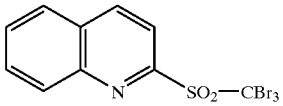

Vinyl Sulfone-1 (VS-1) is described in European Laid Open Patent Application No. 0 600 589 A2 and has the following structure:

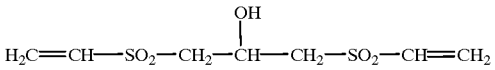

Antihalation Dye-1 (AH-1) is described in PCT Patent Application No. WO 95/23,357 (filed Jan. 11, 1995) and is believed to have the following structure:

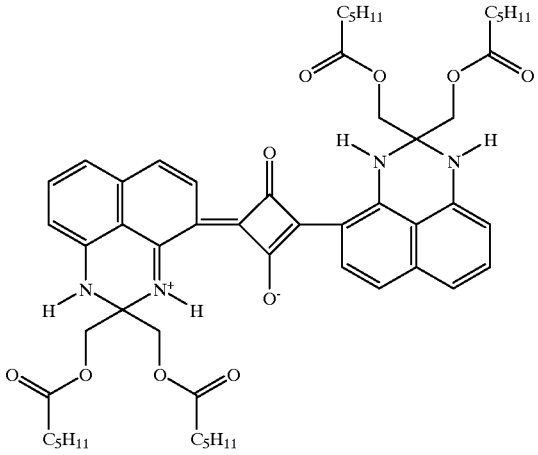

The following examples provide exemplary synthetic procedures and preparatory procedures using the compounds of the invention.

Synthesis of Co-developers

Compound I-01: 2-(Ethoxymethylene)-1H-indene-1,3(2H)-dione [CAS No. 59117-83-8] was prepared by refluxing 1,3-indanedione with triethylorthoformate in acetic anhydride.

Compound I-02: 5-(Ethoxymethylene)-2-thioxorhodanine [CAS No. 86240-28-0] was prepared using the procedure of C-P Lo et al., *J. Amer Chem. Soc*, 76, 4166–69 (1954).

Compound I-03: 5-(Hydroxymethylene)-1,3-dimethyl-2,4,6(1H,3H,5H)-pyrimidinetrione [CAS No. 70450-68-9] was prepared according to the procedure of J. W. Clark-Lewis and M. J. Thompson, *J. Chem. Soc.*, 2401–8, (1959).

Compound I-04: The potassium salt of 2-(hydroxymethylene)-5,5-dimethyl-1,3-cyclohexanedione was prepared from the phenyl formamidine derivative of dimedone derivative by treatment with one equivalent of KOH in ethanol at reflux. The phenyl formamidine derivative of dimedone was prepared by refluxing dimedone in toluene with one equivalent of N,N'-diphenylformamidine.

Compound I-05: The potassium salt of 5-(hydroxymethylene)-2,2-dimethyl-1,3-dioxane4,6-dione was prepared by treating I-06 with one equivalent of KOH in methanol at 0° C.

Compound I-06: 5-(ethoxymethylene)-2,2-dimethyl-1,3-dioxane4,6-dione [CAS No. 15568-86-2] was prepared according to the procedure of G. Bihlmayer et al., *Monatsh. Chem.*, 98, 564–78 (1967).

Compound I-07: 5-(Ethoxymethylene)-1,3-dimethyl-2,4,6(1H3H,5H)-pyrimidinetrione [CAS No. 155953-50-7] was prepared according to the general procedure of Clark-Lewis and Thompson cited above.

Compound I-08: 4-(Ethoxymethylene)-2-phenyl-5(4H)-oxazolone [CAS No. 15646-46-5] is commercially available from Aldrich Chemical Co.

Compound CI-01: 5-(Ethoxymethylene)-3-(phenylmethyl)-2-thioxo-4-thiazolidinone [CAS No. 194874-54-9] was prepared according to the general procedure of Clark-Lewis and Thompson cited above.

Compound CI-02: 5-(Ethoxymethylene)-3-ethyl-2-thioxo-4-thiazolidinone [CAS No. 1725-45-7] was prepared according to the general procedure of Clark-Lewis and Thompson cited above.

Compound CI-03: 5-(Hydroxymethylone)-2,4,5(1H3H,5H)-pyrimdine-trione [CAS No. 126078-88-4] was prepared according to the procedure of M. Sekiya et al., *Chem. Pharm. Bull.*, 17(4), 810–814 (1969).

Emulsion Preparation

The following examples demonstrate the use of the co-developer compounds of this invention in combination with hindered phenol developers.

The preparation of a preformed silver lodobromiide emulsion, shiver soap dispersion, homogenate, and halidized homogenate solutions used in the Examples is described below.

Photothermographic Formulations—The following describes the preparation of one batch of photothermographic formulation. Enough batches of this formulation were prepared for all coatings in each example. Co-developers were incorporated in the emulsion layer.

A pre-formed iridium-doped core-shell silver carboxylate soap was prepared as described in U.S. Pat. No. 5,434,043 incorporated herein by reference.

The pre-formed soap contained 2.0% by weight of a 0.05 micrometer ($\mu$m) diameter iridium-doped core-shell silver iodobromide emulsion (25% core containing 8% iodide, 92% bromide; and 75% all-bromide shell containing $1\times10^{-5}$ mole of iridium). A dispersion of this silver carboxylate soap containing 25.2% solids (soap), 1.3% BUTVAR B-79 polyvinyl butyral resin, and 73.5% 2-butanone was homogenized."

To 170 grams (g) of this silver soap dispersion maintained at 67° F. (19° C.) was added 40 g of 2-butanone, and a solution of 0.23 g pyridinium hydrobromide perbromide in 1.00 g of methanol. After 1 hour of mixing, a solution of 0.05 g of calcium bromide in 0.35 g methanol and a solution of 0.15 g of zinc bromide in 1.02 g of methanol were added. After 30 minutes, the following infrared sensitizing dye premix was added.

| Material | Amount |
|---|---|
| MMBI | 0.14 g |
| Sensitizing Dye-1 | 0.0067 g |
| CBBA | 2.61 g |
| Methanol | 5.000 g |

After 1 hour of mixing, the temperature was lowered to 52° F. (11° C.) and stirring was continued for an additional 30 minutes, followed by the addition of 45 g of BUTVAR B-79 polyvinyl butyral. Stirring for 15 minutes was followed by addition of 1.3 g of 2-(tribromomethylsulfonyl) quinoline. After 15 minutes, 0.4 g of DESMODUR N3300 was added. After another 15 minutes, 1.05 g of phthalazine was added, followed 15 minutes later by 0.36 g of tetrachlorophthalic acid. Stirring for an additional 15 minutes was followed by addition of 0.53 g of 4-methylphthalic acid. This was followed by the addition of 10.6 g of 1, 1-bis(2-hydroxy-3,5-dimethylphenyl)-3,5,5-trimethylhexane (PERMANAX WSO).

A topcoat solution was prepared in the following manner; 0.56 g of ACRYLOID-21 polymethyl methacrylate and 15 g of CAB 171-15S cellulose acetate butyrate were mixed in 183 g of 2-butanone until dissolved. To this premix was then added 0.27 g of Vinyl Sulfone- (VS-1), 0.50 g of compound Pr-01, and 0.100 g of tetrachlorophthalic anhydride.

Coating and Drying of Samples

Samples were coated out under infrared safelights using a dual-knife coater. The photothermographic emulsion and topcoat formulations were coated onto a 7 mil (177.8 $\mu$m) blue tinted polyethylene terephthalate support provided with an antihalation back coating containing AH-1 in CAB 171-15S resin. After raising the hinged knives, the support was placed in position on the coater bed. The knives were then lowered and locked into place. The height of the knives was adjusted with wedges controlled by screw knobs and measured with electronic gauges. Knife #1 was raised to a clearance corresponding to the desired thickness of the support plus the wet thickness of layer #1. Knife #2 was raised to a height equal to the desired thickness of the support plus the wet thickness of layer #1 plus the wet thickness of layer #2.

Aliquots of solutions #1 and #2 were simultaneously poured onto the support in front of the corresponding knives. The support was immediately drawn past the knives and into an oven to produce a double layered coating. The coated photothermographic element was then dried by taping the support to a belt, which was rotated inside a BLUE-M oven. All samples were dried for 5 minutes at 185° F. (85° C.).

Sensitometry

The coated and dried photothermographic elements prepared above were cut into 1.5-inch×11-inch strips (3.8 cm×27.9 cm) and exposed with a scanning laser sensitometer incorporating an 811 nm laser diode. The total scan time for the sample was 6 seconds. The samples were developed using a heated roll processor for 15 seconds at 255° F. (124° C.).

Densitometry measurements were made on a custom built computer scanned densitometer using a filter appropriate to the sensitivity of the photothermographic element and are believed to be comparable to measurements from commercially available densitometers.

$D_{min}$ is the density of the non-exposed areas after development. It is the average of eight lowest density values on the exposed side of the fiducial mark, $D_{max}$ is the highest density value on the exposed side of the fiducial mark.

Speed-2 is Log1/E+4 corresponding to the density value of 1.00 above $D_{min}$ where P is the exposure in ergs/cm$^2$.

Speed-3 is Log1/E+4 corresponding to the density value of 2.90 above $D_{min}$ where E is the exposure in ergs/cm$^2$.

Average Contrast-1 (AC-1) is the absolute value of the slope of the line joining the density points of 0.60 and 2.00 above $D_{min}$.

Average Contrast-2 (AC-2) is the absolute value of the slope of the line joining the density points 1.00 and 2.40 above $D_{min}$.

Average Contrast-3 (AC-3) is the absolute value of the slope of the line joining the density point; of 2.40 and 2.90 above $D_{min}$.

Toe Contrast-1 (TC-1) is the absolute value of the slope of the line joining the density points 0.30 above $D_{min}$–0.45 LogE and 0.30 above $D_{min}$–0.20 LogE.

Toe Contrast-2 (TC-2) is the absolute value of the slope of the line joining the density points 0.30 above $D_{min}$–0.20 LogE and 0.30 above $D_{min}$.

Contrast A is the absolute value of the slope of the line joining the density points of 0.07 and 0.17 above $D_{min}$.

Contrast D is the absolute value of the slope of the line joining the density points of 1.00 and 3.00 above $D_{min}$.

The co-developer compounds of this invention were studied with a hindered phenol developer system using PERMANAX WSO as the hindered phenol developer. The structure of the co-developer compounds studied are shown above.

Example 1

Compounds I-01 to I-08 and comparatives CI-01 to CI-03 were evaluated as co-developers for photothermographic imaging elements. Varying amounts of co-developer were added to a 20 g aliquot of the topcoat solution prepared as described above. The amounts added are shown in the table below. A sample containing only PERMANAX WSO and no co-developer was also prepared. It served as a control.

The photothermographic emulsion and topcoat formulation were dual knife coated onto a 7 mil (178 $\mu$m) polyester support containing AH-1 in an antihalation backcoat. The first knife gap for the photothermographic emulsion layer was set to 2.5 mil (64 $\mu$m) above the support and the second knife gap for the topcoat layer was set at 4.8 mil (122 $\mu$m) above the support. Samples were dried for 5 minutes at 188° F. (87° C.) in a BLUE-M oven.

Samples were imaged and developed as described above. The sensitometric results, shown below in Tables 1 and 2, demonstrate that addition of the novel co-developer compounds of this invention increases the contrast, speed, and $D_{max}$ of a photothermographic emulsion containing a hindered phenol developer. Different compounds are effective at different levels of addition. It is also noteworthy that the $D_{max}$ was increased while the $D_{min}$ was suppressed. The sensitometric response (as shown in Table 2) is similar to that observed for high contrast hybrid wet silver halide emulsions.

TABLE 1

| Ex. | Co-developer | Dmin | Dmax | Speed-2 |
|---|---|---|---|---|
| 1-1 | none - average of five samples | 0.182 | 2.956 | 1.762 |
| 1-2 | 28 mg of I-01 | 0.181 | 3.707 | 1.894 |

TABLE 1-continued

| Ex. | Co-developer | Dmin | Dmax | Speed-2 |
|---|---|---|---|---|
| 1-3 | 55 mg of I-01 | 0.178 | 4.595 | 2.040 |
| 1-4 | 83 mg of I-01 | 0.180 | 4.668 | 2.035 |
| 1-5 | 10 mg of I-02 | 0.187 | 4.136 | 1.906 |
| 1-6 | 17 mg of I-02 | 0.191 | 4.594 | 1.962 |
| 1-7 | 24 mg of I-02 | 0.202 | 4.731 | 2.005 |
| 1-8 | 25 mg of I-03 | 0.176 | 3.334 | 1.653 |
| 1-9 | 50 mg of I-03 | 0.179 | 4.048 | 1.736 |
| 1-10 | 28 mg of I-04 | 0.179 | 2.601 | 1.738 |
| 1-11 | 56 mg of I-04 | 0.183 | 3.779 | 1.826 |
| 1-12 | 84 mg of I-04 | 0.187 | 4.090 | 1.854 |
| 1-13 | 112 mg of I-04 | 0.186 | 4.335 | 1.825 |
| 1-14 | 29 mg of I-05 | 0.177 | 2.473 | 1.583 |
| 1-15 | 57 mg of I-05 | 0.177 | 3.009 | 1.699 |
| 1-16 | 86 mg of I-05 | 0.175 | 2.907 | 1.617 |
| 1-17 | 25 mg of I-06 | 0.177 | 2.487 | 1.579 |
| 1-18 | 51 mg of I-06 | 0.180 | 3.233 | 1.696 |
| 1-19 | 76 mg of I-06 | 0.180 | 3.400 | 1.584 |
| 1-20 | 35 mg of I-07 | 0.189 | 2.361 | 1.444 |
| 1-21 | 70 mg of I-07 | 0.191 | 3.255 | 1.407 |
| 1-22 | 104 mg of I-07 | 0.198 | 3.356 | 1.241 |
| 1-23 | 88 mg of I-08 | 0.182 | 2.822 | 1.793 |
| 1-24 | 118 mg of I-08 | 0.183 | 2.964 | 1.754 |

Compounds CI-01 and CI-02 generate a fogging agent for dry silver resulting in high $D_{min}$ and no contrast enhancement.

| | | | | |
|---|---|---|---|---|
| 1-25 | 10 mg of CI-01 | 0.393 | 2.920 | 1.720 |
| 1-26 | 89 mg of CI-01 | 0.881 | 2.185 | 0.758 |
| 1-27 | 114 mg of CI-02 | 0.862 | 2.528 | 1.250 |
| 1-28 | Compound CI-03 was insoluble in organic solvents. | | | |

TABLE 2

| Ex. | AC-1 | AC-2 | AC-3 | TC-1 | TC-2 |
|---|---|---|---|---|---|
| 1-1 | 4.902 | 3.127 | *** | 0.227 | 1.158 |
| 1-2 | 17.491 | 22.115 | 32.094 | 0.193 | 1.213 |
| 1-3 | 31.880 | 39.368 | 32.225 | 0.066 | 1.399 |
| 1-4 | 33.972 | 42.544 | 42.592 | 0.057 | 1.410 |
| 1-5 | 19.674 | 23.940 | 27.966 | 0.190 | 1.217 |
| 1-6 | 25.144 | 33.002 | 34.083 | 0.141 | 1.288 |
| 1-7 | 26.251 | 33.668 | 38.748 | *** | 1.372 |
| 1-8 | 16.534 | 23.109 | *** | 0.241 | 1.156 |
| 1-9 | 22.935 | 30.247 | 27.385 | 0.245 | 1.150 |
| 1-10 | 8.473 | *** | *** | 0.249 | 1.132 |
| 1-11 | 20.871 | 27.426 | 19.987 | 0.254 | 1.117 |
| 1-12 | 31.181 | 36.576 | 31.731 | 0.218 | 1.183 |
| 1-13 | 30.050 | 38.738 | 35.264 | 0.183 | 1.240 |
| 1-14 | 4.325 | *** | *** | 0.266 | 1.106 |
| 1-15 | 8.822 | 13.126 | *** | 0.260 | 1.122 |
| 1-16 | 12.028 | 16.150 | *** | 0.252 | 1.126 |
| 1-17 | 4.221 | *** | *** | 0.252 | 1.818 |
| 1-18 | 7.067 | 11.719 | 11.441 | 0.255 | 1.132 |
| 1-19 | 7.776 | 11.804 | 8.171 | 0.250 | 1.134 |
| 1-20 | *** | *** | *** | 0.256 | 1.124 |
| 1-21 | 3.093 | 3.474 | 2.031 | 0.297 | 1.061 |
| 1-22 | 2.531 | 3.471 | *** | 0.319 | 1.019 |
| 1-23 | 2.344 | *** | 0.217 | 1.178 | 2.018 |
| 1-24 | 5.156 | 3.188 | *** | 0.237 | 1.143 |

Compounds CI-01 and CI-02 generate a fogging agent for dry silver resulting in high $D_{min}$ and no contrast enhancement.

| | | | | | |
|---|---|---|---|---|---|
| 1-25 | 3.175 | *** | *** | 0.242 | 1.102 High Fog |
| 1-26 | *** | *** | *** | 0.332 | 0.788 |
| 1-27 | *** | *** | *** | 0.159 | 0.375 High Fog |

Compound CI-03 was insoluble in organic solvents.
***Could not be measured.

Example 2

To 20 g of the topcoat solution prepared as described above, was added:

Sample 2-1 contained 83 mg of compound I-01;

Sample 2-2 contained 17 mg of compound I-02;

Sample 2-3 contained 112 mg of compound I-04;

Sample 2-4 contained 8.8 mg of compound CN-08; and

Sample 2-5 contained 8.0 mg of compound CN-14.

All samples were coated, dried, imaged, and developed as described above.

The initial sensitometry of three high contrast agents of this invention and two known high contrast agents (CN-08 and CN-14) were compared. The data, shown in Table 3 below, demonstrates that the high contrast agents of this invention have comparable initial sensitometry.

TABLE 3

| Ex. | Co-developer | Dmin | Dmax |
|---|---|---|---|
| 2-1 | I-01 | 0.178 | 4.645 |
| 2-2 | I-02 | 0.190 | 4.498 |
| 2-3 | I-04 | 0.185 | 4.356 |
| 2-4 | CN-08 | 0.180 | 4.845 |
| 2-5 | CN-14 | 0.179 | 4.753 |
| **Ex.** | **Speed 3** | **Contrast-A** | **Contrast-D** |
| 2-1 | 1.99 | 2.533 | 41.677 |
| 2-2 | 1.90 | 1.046 | 30.819 |
| 2-3 | 1.76 | 0.826 | 33.675 |
| 2-4 | 1.88 | 0.839 | 35.000 |
| 2-5 | 1.88 | 0.831 | 34.445 |

Example 3

To 20 g of the topcoat solution prepared as described above was added:

Sample 3-1 contained 83 mg of compound I-01,

Sample 3-2 contained 17 mg of compound I-02;

Sample 3-3 contained 112 mg of compound I-04;

Sample 3-4 contained 8.8 mg of compound CN-08; and

Sample 3-5 contained 8.0 mg of compound CN-14.

All samples were coated, dried, and imaged as described above. These samples were developed using a heated roll processor for 25 seconds at 255° F. (124°C.).

The initial sensitometry of three high contrast agents of this invention and two known high contrast agents (CN-08 and CN-14) were compared. The data, shown in Table 4 below, demonstrates that the high contrast agents of this invention have comparable initial sensitometry.

TABLE 4

| Ex. | Co-developer | Dmin | Dmax |
|---|---|---|---|
| 3-1 | I-01 | 0.193 | 4.890 |
| 3-2 | I-02 | 0.244 | 4.694 |
| 3-3 | I-04 | 0.217 | 4.467 |
| 3-4 | CN-08 | 0.192 | 4.851 |
| 3-5 | CN-14 | 0.201 | 4.987 |
| **Ex.** | **Speed 3** | **Contrast-A** | **Contrast-D** |
| 3-1 | 2.32 | 2.602 | 32.861 |
| 3-2 | 2.16 | 0.661 | 38.230 |
| 3-3 | 2.05 | 2.489 | 37.877 |
| 3-4 | 2.15 | 2.194 | 42.676 |
| 3-5 | 2.17 | 1.919 | 42.825 |

Example 4

The following example demonstrates the incorporation of the co-developers of this invention in the photothermographic emulsion layer. No co-developers were incorporated into the topcoat formulation.

To 60 g aliquots of photothermographic emulsion prepared as above was added:

Sample 4-1 contained no co-developer (his served as a control);

Sample 4-2 contained 0.083 g of compound I01;

Sample 4-3 contained 0.030 g of compound CI-01;

Sample 4-4 contained 0.038 g of compound CI-02;

Sample 4-5 contained 0.020 g of N-Ethyl-rhodarine; and

Sample 4-6 contained 0.040 g of N-Ethyl-rhodanine.

All samples were coated, dried, and imaged, as described above. These samples were dried for 5 minutes at 188° F. (87° C.) in a BLUE-M oven.

The results, shown below in Table 5, demonstrate that ethyl-rhodanine behaves in a manner similar to compounds CI-01 or CI-02 in photothermographic formulations. It appears to generate a fogging agent and results in samples having high $D_{min}$ and no contrast enhancement.

TABLE 5

| Ex. | Co-developer | Dmin | Dmax |
|---|---|---|---|
| 4-1 | None | 0.179 | 2.803 |
| 4-2 | I-01 | 0.180 | 4.668 |
| 4-3 | CI-01 | 0.532 | 2.678 |
| 4-4 | CI-02 | 1.005 | 3.062 |
| 4-5 | N-Ethyl-rhodanine | 3.373 | 4.638 |
| 4-6 | N-Ethyl-rhodanine | 4.140 | 4.936 |
| **Ex.** | **Speed 2** | **AC-1** | **AC-3** |
| 4-1 | 1.69 | 4.862 | 2.431 |
| 4-2 | 2.04 | 33.972 | 42.544 |
| 4-3 | 1.76 | 1.911 | * |
| 4-4 | 1.71 | * | * |
| 4-5 | * | * | * |
| 4-6 | * | * | * |

Speed-2, AC-1, and AC-3 were too low to measure.

Example 5

Solubility of Co-developers: In order for the co-developer to perform effectively, some quantity of the co-developer must be soluble in the coating solvent for the emulsion layer or topcoat layer. 2-Butanone MEK) and methanol are typical solvents for these layers. Solubility will vary depending on the structure of the co-developer, the composition of the layer containing the co-developer, and the solvents employed.

The photothermographic elements of this invention typically require from 10 mg to 100 mg of co-developer in 40 g of photothermographic emulsion in 25 g 2-butanone in order to achieve high contrast. The photothermographic emulsions are held at 50° F. (10° C.). As this is below room temperature, the solubility is below that of the co-developer at room temperature.

The solubility of co-developer CI-03 in 25 g of 2-butanone (MEK) and in 25 g of methanol was determined.

| Solubility in MEK | |
|---|---|
| 2.5 mg CI-03 in 25 g 2-butanone | Soluble at room temperature. |
| 5.0 mg CI-03 in 25 g 2-butanone | Soluble at 90° F. (32° C.). Insoluble at room temperature. |
| 12.5 mg CI-03 in 25 g 2-butanone | Insoluble at 90° F. (32° C.). |
| 25 mg CI-03 in 25 g 2-butanone | Insoluble at 90° F. (32° C.). |
| **Solubility in MeOH** | |
| 5 mg CI-03 in 25 g methanol | Soluble at room temperature. |
| 12.5 mg CI-03 in 25 g methanol | Soluble at 90° F. (32° C.). Insoluble at room temperature. |
| 25 mg CI-03 in 25 g methanol | Soluble at 90° F. (32° C.). Insoluble at room temperature. |

The results, shown above, suggest that although CI-03 might be a co-developer in photothermographic elements coated from some solvents, it is not effective in photothermographic elements coated from 2-butanone or methanol.

Reasonable modifications and variations are possible from the foregoing disclosure without departing from either the spirit or scope of the present invention as defined by the claims.

We claim:

1. A black-and-white photothermographic element comprising a support having coated thereon an imaging coating comprising:

(a) a photosensitive silver halide;

(b) a non-photosensitive, reducible silver source;

(c) a reducing agent system for silver ion; and (d) a binder;

wherein the reducing agent system comprises:

(i) a hindered phenol; and (ii) a non-fogging co-developer either of the formula

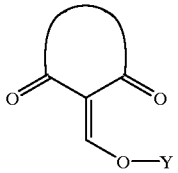

or of the formula

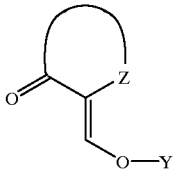

wherein Y in either formula is H, a metal cation, or an alkyl group, Z is a sulfur or nitrogen atom, and the solid curved line in either formula represents the carbon, oxygen, sulfur or nitrogen atoms and bonds necessary to complete a 5- or 6-membered main ring that can have at least one pendant or fused ring attached thereto.

2. The photothermographic element according to claim 1 wherein Y is H, an alkali metal, or an alkyl group having from 1 to 4 carbon atoms.

3. The photothermographic element according to claim 1 wherein said co-developer is selected from the group consisting of:

I-01

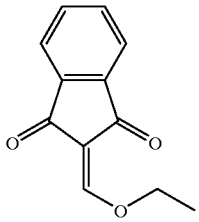

I-02

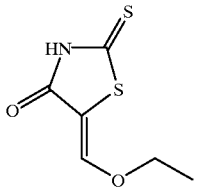

I-03

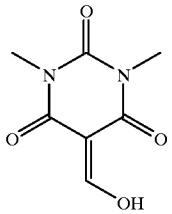

I-04

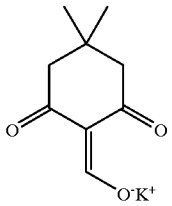

I-05

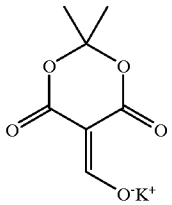

I-06

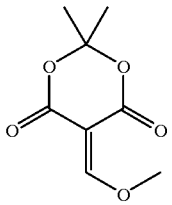

I-07

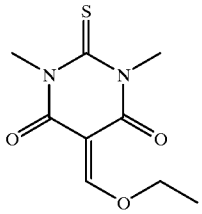

-continued

I-08

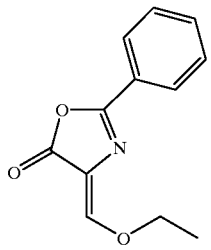

and mixtures thereof.

4. The photothermographic element according to claim 1 wherein said non-photosensitive, reducible silver source comprises a silver salt of an aliphatic carboxylic acid having from 10 to 30 carbon atoms.

5. The photothermographic element according to claim 1 wherein said non-photosensitive, reducible silver source comprises a mixture of silver salts of aliphatic carboxylic acids.

6. The photothermographic element according to claim 1 wherein said binder is hydrophobic.

7. The photothermographic element according to claim 1 wherein at least 10 mg of said non-fogging co-developer is soluble in 25 g of solvent used for coating said non-fogging co-developer at about room temperature.

8. The photothermographic element according to claim 1 wherein said hindered phenol is selected from the group consisting of binaphthols, biphenols, bis(hydroxynaphthyl) methanes, bis(hydroxyphenyl)methanes, and naphthols.

9. The photothermographic element according to claim 8 wherein said hindered phenol is a bis(hydroxyphenyl) methane.

10. The photothermographic element according to claim 1 wherein said reducing agent system for silver ion is present in an amount of about 1% to 20% by weight of the imaging coating.

11. The photothermographic element according to claim 1 wherein said non-photosensitive, reducible silver source is formed in the presence of the silver halide.

12. A process of forming a visible image comprising:

(a) exposing the photothermographic element of claim 1 on a support transparent to ultraviolet radiation or short wavelength visible radiation, to electromagnetic radiation to which the photosensitive silver halide of the element is sensitive to generate a latent image; and thereafter heating said element to form a visible image thereon;

(b) positioning said element with a visible image thereon between a source of ultraviolet or short wavelength visible radiation and an ultraviolet or short wavelength visible radiation photosensitive imageable medium; and (c) then exposing said ultraviolet or short wavelength visible radiation sensitive imageable medium to ultraviolet or short wavelength visible radiation through said visible image on said element, thereby absorbing ultraviolet or short wavelength visible radiation in the areas of said element where there is a visible image and transmitting ultraviolet or short wavelength visible radiation where there is no visible image on said element.

13. The process of claim 12 wherein said imageable medium is an ultraviolet or short wavelength visible radiation sensitive photopolymer, diazo material, or photoresist.

14. The process of claim 12 wherein said exposing of said element in step (a) is done with a red or infrared emitting laser or a red or infrared emitting laser diode.

15. The process of claim 12 wherein said ultraviolet or short wavelength visible radiation sensitive imageable medium is a printing plate, a contact proof or a duplicating film.

* * * * *